US005953749A

United States Patent [19]

Backs

[11] Patent Number: 5,953,749

[45] Date of Patent: Sep. 21, 1999

[54] ABDOMINAL SUPPORT DEVICE

[76] Inventor: Jason Backs, 15811 Oak Mountain, Houston, Tex. 77095

[21] Appl. No.: 08/929,532

[22] Filed: Sep. 15, 1997

[51] Int. Cl.[6] ..... A47C 20/00

[52] U.S. Cl. ..... 2/1; 2/464; 128/99.1; 128/845; 5/630

[58] Field of Search ..... 2/464, 1, 465, 2/912, 920, 311, 312, 318, 321, 323, 338; 128/96.1, 99.1, 100.1, 845, 846, 869, 870, 871, 874, 876; 5/655, 657, 630, 652, 632, 465, 922

[56] References Cited

U.S. PATENT DOCUMENTS

| | | | |
|---|---|---|---|
| 4,288,879 | 9/1981 | Pate . | |
| 4,294,239 | 10/1981 | Oram et al. | 128/96.1 |
| 4,397,052 | 8/1983 | Lund . | |
| 4,506,396 | 3/1985 | Ritchie . | |
| 4,952,192 | 8/1990 | Burke . | |
| 5,054,142 | 10/1991 | Owens . | |
| 5,062,414 | 11/1991 | Grim . | |
| 5,094,648 | 3/1992 | Turner . | |
| 5,182,828 | 2/1993 | Aliuizatos . | |
| 5,189,748 | 3/1993 | Garrison . | |
| 5,193,238 | 3/1993 | Clute . | |
| 5,199,124 | 4/1993 | Klemis | 5/630 |
| 5,257,419 | 11/1993 | Alexander . | |
| 5,272,780 | 12/1993 | Clute . | |
| 5,302,171 | 4/1994 | Pearson . | |
| 5,345,633 | 9/1994 | Harnish | 5/640 X |
| 5,347,669 | 9/1994 | Neviaser et al. | 5/655 |
| 5,412,824 | 5/1995 | Emerson . | |
| 5,544,377 | 8/1996 | Gostine . | |
| 5,571,039 | 11/1996 | Ford . | |
| 5,575,027 | 11/1996 | Mueller . | |
| 5,584,302 | 12/1996 | Sillaway et al. | 128/845 |

*Primary Examiner*—Gloria Hale

[57] ABSTRACT

One or more generally wedge shaped foam support cushions (20A, 20B) covered by a soft, washable, and close fitting material (29) for supporting an enlarged abdomen (24). The support cushions (20A, 20B) are uniquely and adjustably secured adjacent to the abdomen by hook and loop fasteners (22A, 22B, 22C, 22D) on an elastic belt (21). The elastic belt (21) encompasses the person (23) and the support cushions (20A, 20B) and has opposite ends that overlap and engage adjustably with hook and loop fasteners (22E, 22F).

3 Claims, 2 Drawing Sheets

ABDOMINAL SUPPORT DEVICE

BACKGROUND—FIELD OF THE INVENTION

Figure 1:
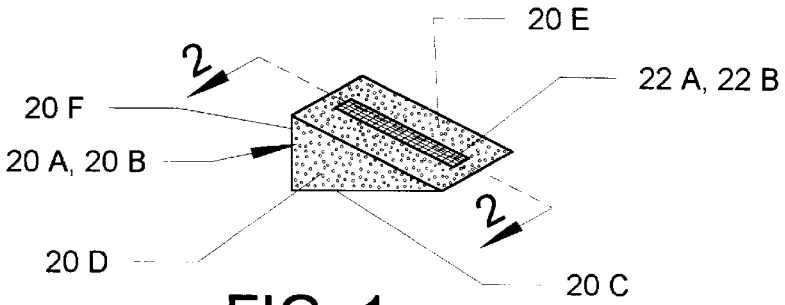

The present invention is in the field of comfort enhancing items and is more specifically directed to one or more supporting structures which are uniquely attached to provide support for the wearer's enlarged abdomen while lying on either side.

BACKGROUND—DESCRIPTION OF PRIOR ART

Physicians recommend that a pregnant woman sleep on her side rather than on her back or abdomen to provide the best position for the developing child. However, as the mother rests on her side, the weight of the developing baby in the abdomen causes an abnormal posture as the abdomen sags to the resting surface under the influence of gravity. This abnormal sagging can aggravate or promote certain back or neck conditions. The resulting discomfort promotes poor quality sleep that is unhealthy for the mother as well as the developing baby.

Three distinct categories of devices have been developed which attempt to address the abdominal support problem, but have at best only provided transitory relief: small pillows (often wedged shaped), whole body support cushions, elastic undergarments/straps.

Small pillows have been designed to support the abdomen. However, the pillows are not attached to the user so that when any change in position occurs during the sleeping period, proper support of the abdomen by the pillow is lost and the original discomfort returns. The independent nature of these unattached designs severely limits their functionality. The following U.S. Pat. Nos. are examples.

5,189,748 4,288,879 5,216,772 5,347,669 5,182,828 5,272,780 5,193,238 4,506,396 4,397,052 5,544,377 5,062,414

Whole body support cushions have been proposed. These devices are large, cumbersome and also lack any means of attachment to the user. The following U.S. Pat. Nos. are examples.

5,054,142 5,412,824

Elastic undergarments/straps have been proposed. These devices are designed for the support of the abdomen while the user is in a standing position and make no provisions for the user in a reclined position. They make no use of a pillow or cushion for support. The following U.S. Pat. Nos. are examples.

5,571,039 5,302,171 4,952,192 5,575,027 5,094,648 5,257,419

In accordance with the present invention, I have discovered that a wedge shaped cushion that is properly adjusted and attached to the user can help support an enlarged abdomen and remain in place throughout the duration of the rest period and thereby greatly reducing the level of discomfort. This invention fulfills an unmet need for a versatile and compact abdominal support assembly capable of adjustment to accommodate persons of different sizes while providing a secure attachment to maintain the proper advantageous support. The support cushions of the present invention is placed between the abdomen and the surface of the bed while the wearer is lying on her side. If the wearer moves or rotates during the sleeping period, the support cushions are comfortably held in place against the sides of the user's abdomen by an elastic belt. Proper positioning of the support cushions between the abdomen and the surface of the bed is thereby maintained.

Since the bodies of different users will obviously have vastly different sizes and shapes (and since a single user's body will change in size and shape during the course of her pregnancy), adjustment of the belt as well as the attachment of the support cushions relative to the belt is necessary. The present invention provides for an infinite adjustment of the belt to ensure the wearer is completely and snugly encompassed. Also, the positioning of the support cushions relative to the belt is infinitely adjustable so as to secure their correct position relative to the abdomen of the user.

The present invention is a new and improved therapeutic device. The novelty of the device lies in the ability to remain secured in position on the wearer during the sleeping period. This invention promotes the highest quality sleep for the longest duration that is extremely important for the health and well being of the expectant mother as well as the developing baby.

OBJECTS AND ADVANTAGES

Accordingly, besides the objects and advantages of the abdominal support device described in this patent, several objects and advantages of the present invention are:

(a) to provide comfortable support for an enlarged abdomen;

(b) to provide an elastic belt for the attachment of the support cushions to a person so as to secure the position of the support cushions to the side of the person's abdomen;

(c) to provide infinite adjustment of the belt so as to accommodate various size torsos; and (d) to provide infinite adjustment of the connection between the support cushions and the belt to provide the most advantageous position relative to the person's abdomen.

Further objects and advantages are to provide support for an enlarged abdomen and to provide a comfortable and universally adjustable attachment to the wearer so as to secure the position of the support cushions to the abdomen during a resting period regardless of the person's tossing and turning, and which obviates the need to continually rearrange throughout the resting period a support cushion which is independent of the user. Still further objects and advantages will become apparent from a consideration of the ensuing description and drawings. Such features, modifications and improvements are, therefore, considered to be a part of this invention, the scope of which is to be determined by the claims.

DRAWING FIGURES

In the drawings, closely related figures and reference parts have the same number but different alphabetical suffixes.

FIG. 1 Right/left support cushion

Figure 2:
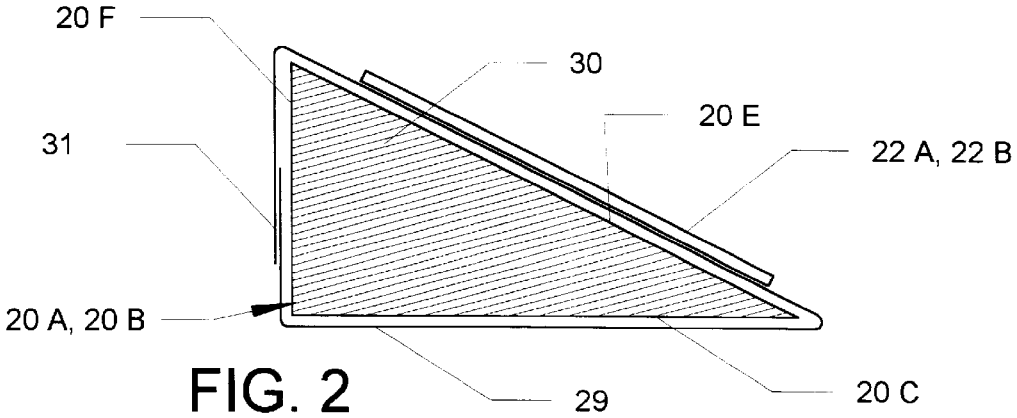

FIG. 2 Cross section of support cushion

Figure 3:
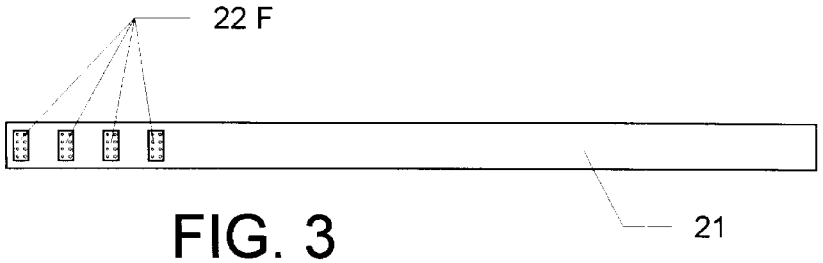

FIG. 3 Outside face of belt

Figure 4:
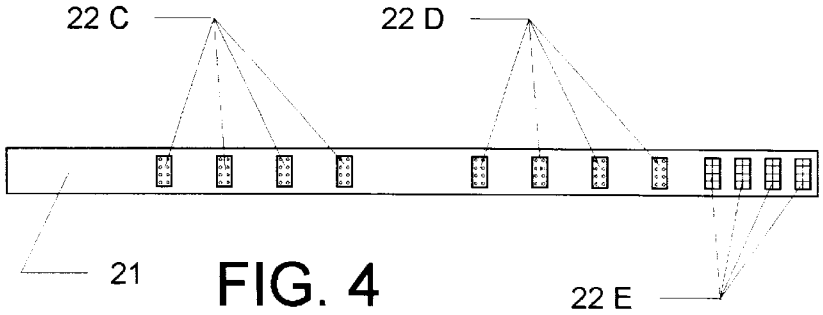

FIG. 4 Inside face of belt

Figure 5:
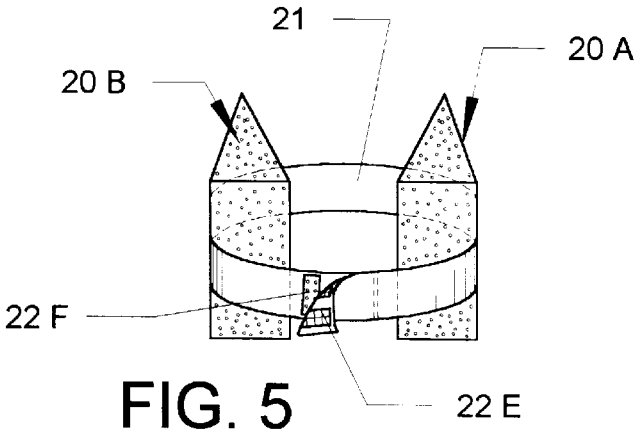

FIG. 5 Support cushions engaged with belt.

Figure 6:
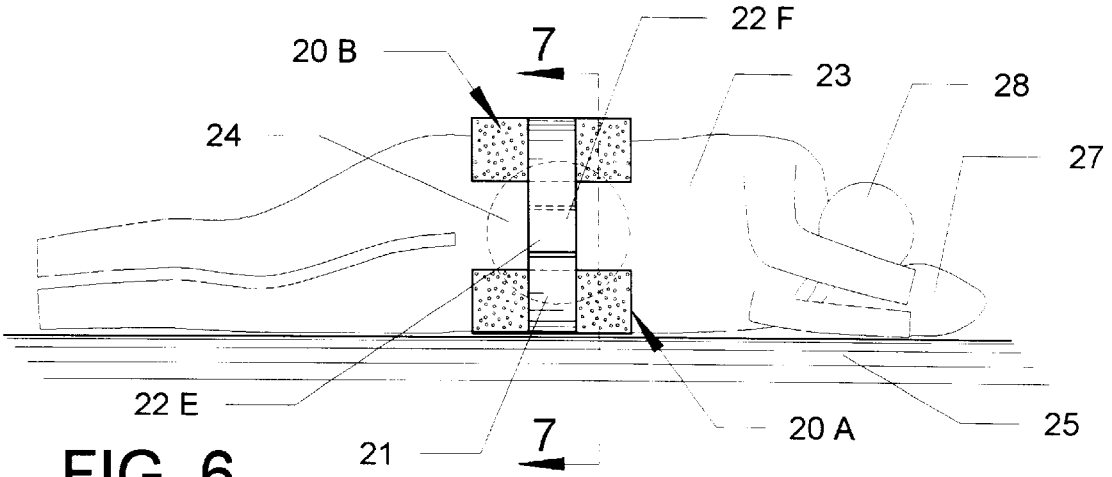

FIG. 6 Person on side with supports adjusted and belt engaged with the person and the supports.

Figure 7:
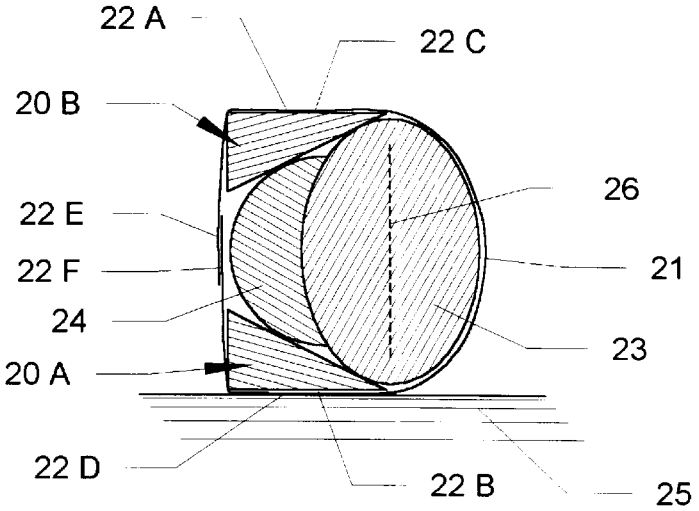

FIG. 7 Cross section of person at their mid section with supports adjusted and belt engaged with the person and the supports.

REFERENCE NUMERALS IN DRAWINGS

20A LEFT SUPPORT

20B RIGHT SUPPORT

20C SUPPORT CUSHION BASE SURFACE

20D SUPPORT CUSHION SIDE SURFACE

20E SUPPORT CUSHION TOP SLOPED SURFACE

20F SUPPORT CUSHION BACK VERTICAL SURFACE

21 ELASTIC BELT

22A 'BELT TO SUPPORT CUSHION' HOOK CONNECTOR, RIGHT SIDE

22B 'BELT TO SUPPORT CUSHION' HOOK CONNECTOR, LEFT SIDE

22C 'BELT TO SUPPORT CUSHION' LOOP CONNECTOR, RIGHT SIDE

22D 'BELT TO SUPPORT CUSHION' LOOP CONNECTOR, LEFT SIDE

22E 'BELT TO BELT' HOOK CONNECTOR

22F 'BELT TO BELT' LOOP CONNECTOR

23 PERSON

24 ENLARGED ABDOMEN

25 RESTING SURFACE

26 SHOULDER ORIENTATION PLANE

27 STANDARD PILLOW FOR THE HEAD

28 PERSON'S HEAD

29 FABRIC COVER

30 POLYURETHANE FOAM WEDGE

31 OVERLAPPING PANELS

SUMMARY

In accordance with the present invention, a device comprises one or more support cushions for supporting an enlarged abdomen and includes an adjustable belt that has an adjustable means of attachment to the support cushions. The belt the wearer's torso to secure the support cushions to maintain their positions on either side of the abdomen.

Description—FIGS. 1 to 5

A typical embodiment of the support device of the present invention is illustrated in FIG. 5. The components comprising the device are illustrated separately in FIGS. 1 to 4.

FIGS. 1 and 2 illustrate the preferred embodiment for the support cushion. The support cushion 20A and support cushion 20B are identical. The support cushion 20A is comprised of a polyurethane foam core 30. The base 20C is generally rectangular in shape. The support cushion back vertical face 20F is perpendicular to the base surface 20C and is generally rectangular in shape. The support cushion side surface 20D is perpendicular to the base surface 20C and is generally triangular in shape. The support cushion sloped surface 20E is generally rectangular in shape. The surfaces interact with the adjacent surfaces to comprise a three dimensional wedge shape. The cover 29 is made of a cotton/poly fabric and is sewn into a wedge shape to closely cover the foam wedge 30. The 'belt to support cushion' hook connector 22A is sewn to the cover 29. The connector 22A is oriented along the slope of surface 20E and extends across the majority of the length. FIG. 2 shows the support structure in cross section. The cover 29 closely encases the foam wedge 30. The back vertical face 20F has overlapping panels 31 that allow the foam core 30 to be removed for cleaning.

FIGS. 3 and 4 show the outside and inside of the elastic belt 21 respectively. The ends of belt 21 are designed to overlap so as to form a closed loop. On the outside of belt 21, several strips of loop connectors 22F are attached which engage with the hook connectors 22E on the opposite side and opposite end of belt 21. The hook and loop connectors 22E and 22F are spaced down the length of belt 21 to permit more or less overlap of the opposite ends of the belt 21 which provides a loop of smaller or larger size. Loop connectors 22C and 22D are spaced down the length of belt 21 and engage with the hook connectors 22A and 22B respectively. The length of the hook connectors 22A and 22B and the spacing of the loop connectors 22C and 22D allow the support 20A and 20B to be secured at any point on the length of belt 21.

FIG. 5 illustrates the belt 21 engaged with the supports 20A and 20B. The ends of belt 21 are overlapped and engaged by hook and loop fasteners 22E and 22F.

Operation—FIGS. 6 to 7

FIGS. 6 and 7 illustrate the abdominal support device in proper adjustment in a frontal view and in cross section respectively. The person 23 is resting on her left side on a supporting surface 25. A standard pillow 27 supports the person's head 28. The left support cushion 20A supports the enlarged abdomen 24. The support cushions 20A and 20B are adjusted to either side of the abdomen 24. The belt 21 encompasses the person 23 as well as the support cushions 20A and 20B. The belt 21 is secured in circumference by overlapping the opposite ends and engaging the hook and loop connectors 22E and 22F. The supports 20A and 20B are engaged with the belt 21 by the hook and loop connectors 22A and 22C on the right side and 22B and 22D on the left side. The assembly is symmetric about the person 23 so as the person rolls onto her right or left side, the appropriate support cushion 20B will engage the resting surface 25 and provide support to the abdomen 24.

Conclusion, Ramifications, and Scope

Accordingly, the reader will see that the abdominal support device of this invention can be used to provide support to a person with an enlarged abdomen. The device is capable of providing the comfort and support required for a person with the following advantages:

the device is easily adjusted for maximum comfort;

the support cushions can be secured to the abdomen;

the belt is infinitely adjustable to accommodate various size torsos.

Although the description above contains many specifics, these should not be construed as limiting the scope of the invention but as merely illustrations of some of the presently preferred embodiments of this invention. Other embodiments which are intended to be included in this patent would be represented by the following examples: the support cushions could have other shapes, such as round, oval, tubular, rectangular, etc.; the support cushion could be made of other materials, such as polystyrene beads contained in a fabric bag, an air bladder, down feathers in a fabric case, etc.; the belt could be made of other materials, such as cotton, leather, canvas, etc.; the hook and loop fasteners could be replaced with buttons, snaps, zippers, etc.; the number and spacing of the hook and loop fasteners could be varied and still result in the same securing means; the sewn connections could be replaced with adhesive, buttons, zippers, etc.; the cotton cover for the foam wedge could be replaced with other materials, such as denim, satin, silk, canvas, etc.; the belt could also pass directly around the wearer with the supports attached to the exterior of the belt.

Thus the scope of the invention should be determined by the appended claims and their legal equivalents, rather than by the examples given.

I claim:

1. An abdominal support system comprising in combination:

a. a cushion means to support an enlarged abdomen of a person while laying on a resting surface;

b. at least one elastic belt having opposite ends with a complimentary adjustable fastener component on each end of said belt that engage to form an infinitely adjustable loop to encompass said person and said support means;

c. said elastic belt having an interior and an exterior surface;

d. said interior surface of said belt having a variable fastening means component thereon;

e. said support means having a complimentary fastener component thereon that engages said variable fastening means component on said belt interior surface wherein said support means is adjustably connected along said belt in order to provide support in a desired location when worn.

2. The abdominal support system as claimed in claim 1 wherein said fastening means is at least one set of hook and loop fasteners.

3. The abdominal support system as claimed in claim 2 wherein said support means is comprised of one or more substantially wedge shaped foam cushions covered by a close fitting, removable and soft, washable material.

* * * * *